United States Patent [19]

Franko et al.

[11] 4,219,930

[45] Sep. 2, 1980

[54] CUTTER HEAD ASSEMBLY FOR AN ELECTRIC DRY SHAVER

[75] Inventors: Joseph P. Franko, Milford; Michael J. Marchetti, Bridgeport, both of Conn.

[73] Assignee: Remington Products, Inc., Bridgeport, Conn.

[21] Appl. No.: 922,878

[22] Filed: Jul. 7, 1978

Related U.S. Application Data

[63] Continuation of Ser. No. 759,933, Jan. 17, 1977, abandoned.

[51] Int. Cl.[2] ..... B26B 19/02

[52] U.S. Cl. ..... 30/43.92

[58] Field of Search ..... 30/43.91, 43.92, 209, 30/216, 218

[56] References Cited

U.S. PATENT DOCUMENTS

| | | | |
|---|---|---|---|
| 2,184,757 | 12/1939 | Samotey | 30/43.92 |
| 2,841,867 | 7/1958 | Padgett | 30/43.92 X |
| 2,844,869 | 7/1958 | Kahn | 30/43.92 |
| 3,092,904 | 6/1963 | Bruecker | 30/43.92 X |
| 3,332,146 | 7/1967 | Kratz | 30/43.92 |
| 4,001,933 | 1/1977 | Czerner | 30/43.92 |
| 4,133,104 | 1/1979 | Ascoli | 30/43.92 |

FOREIGN PATENT DOCUMENTS

| | | | |
|---|---|---|---|
| 939890 | 1/1974 | Canada | 30/43.92 |
| 1241140 | 7/1971 | United Kingdom . | |
| 1388520 | 3/1975 | United Kingdom . | |

*Primary Examiner*—Gary L. Smith

*Attorney, Agent, or Firm*—Charles R. Miranda; Joseph S. Failla

[57] ABSTRACT

An inner cutter assembly drive means for an electric dry shaver having a flexible foil outer cutter wherein the motor operated drive means include an arcuate shaped universal drive head connection between the drive means and the walls of a cutter drive slot in the support member for the inner cutter assembly permitting downward, upward and swiveling movement of the inner cutter during reciprocation to maintain shearing contact with the undersurface of the foil.

7 Claims, 7 Drawing Figures

Fig. 1.
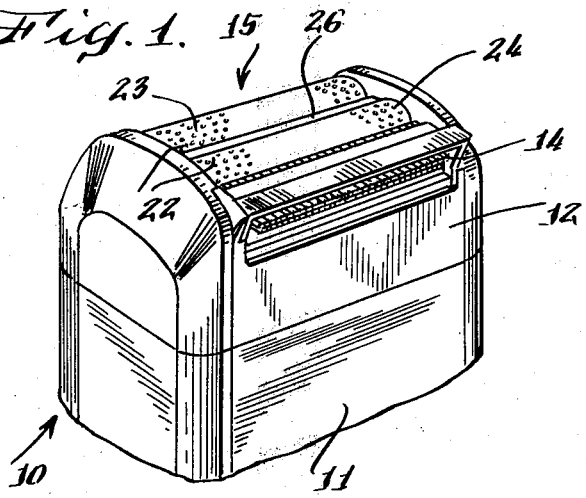
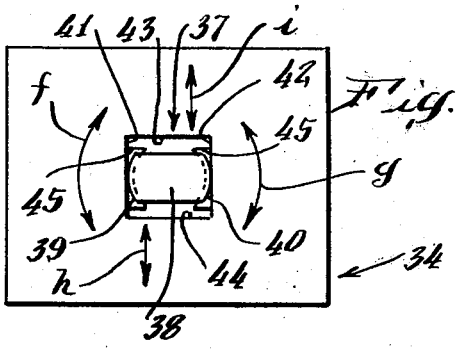
Fig. 7.
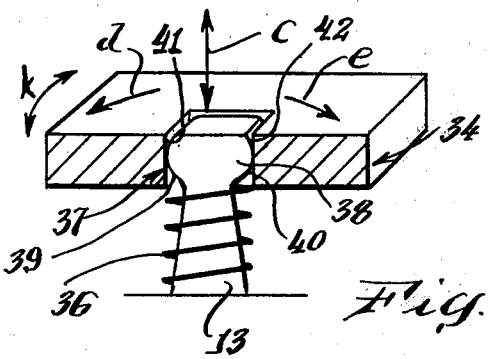
Fig. 6
Fig. 2.
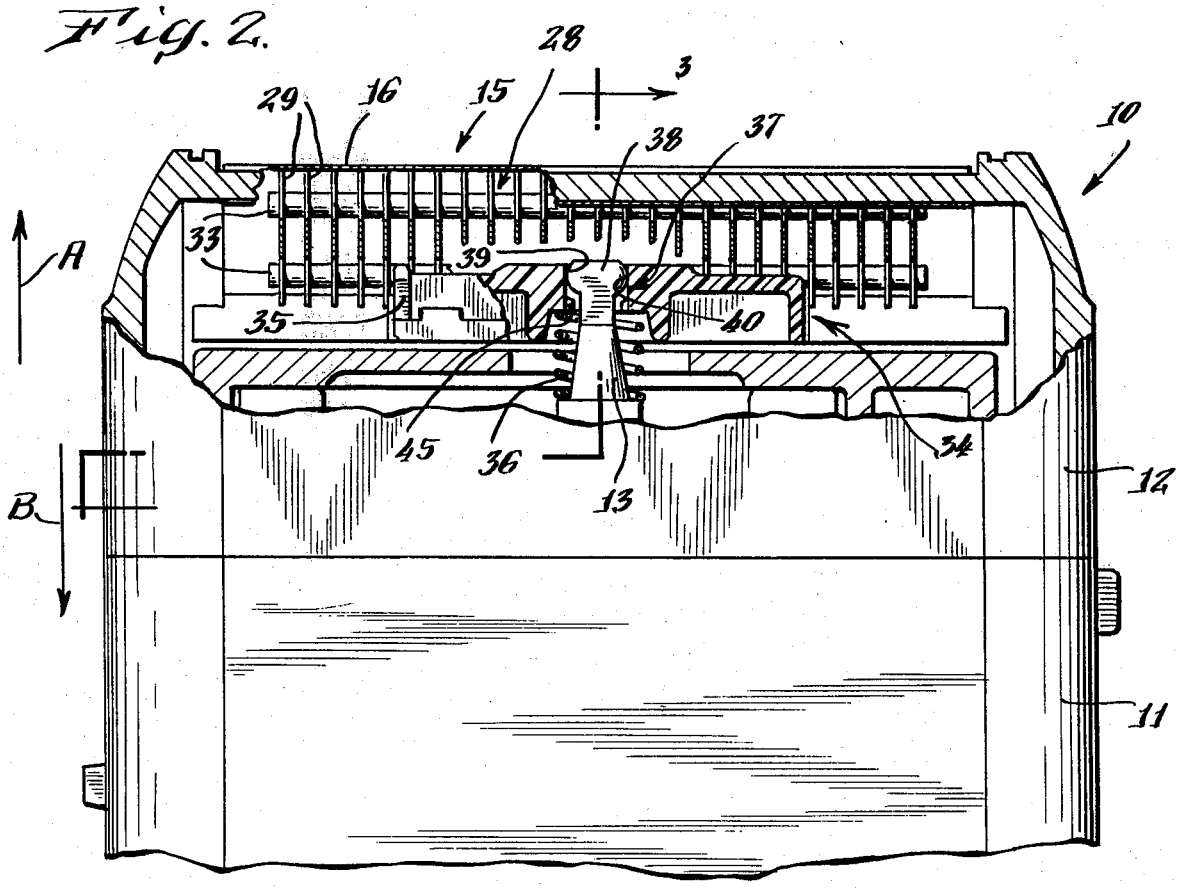

CUTTER HEAD ASSEMBLY FOR AN ELECTRIC DRY SHAVER

This is a continuation of application Ser. No. 759,933 filed Jan. 17, 1977, now abandoned.

BACKGROUND OF THE INVENTION

The present invention is directed to new and useful improvements in electric dry shavers and in particular to means for mounting a movable inner cutter on motor operated drive means.

Electric dry shavers usually include a cutter head assembly comprising an outer cutter and a motor driven inner cutter operable to shear hair bristles combed through slots or apertures in the outer cutter into the path of the moving inner cutter. In certain type eletric dry shavers the outer cutter comprises a thin flexible metallic foil provided with a plurality of hair receiving apertures. The inner cutter is comprised of a plurality of arcuate shaped cutter blades urged into contact with the undersurface of the foil to conform the foil to the arcuate shape of the edges of the cutter blades. Certain of these foil type cutter heads include a plurality of parallel arcuate surfaces in conformance to a like number of rows of arcuate inner cutter blades.

It is known in these foil type shavers to mount the inner cutter on a support member which is interconnected to the motor operated drive means. The outer cutter foil is usually secured to a removable hairpocket section of the shaver casing with spaced longitudinally extending marginal portions connected to the spaced sidewalls of the hairpocket. When the hairpocket section is connected to the main shaver casing the flexible foil engages the resiliently mounted inner cutter to conform to the configuration thereof. In use of the shaver the inner cutter will reciprocate relative to the stationary foil. When the foil outer cutter is pressed against the skin surface it will deflect downwardly against the moving inner cutter. It is desirable that during this movement that the inner cutter be maintained in shearing engagement with the undersurface of the foil for proper cutting action. In order to accommodate the movement of the foil and the downward and sideways movement of the inner cutter in response thereto as it reciprocates, the inner cutter must therefore be permitted to move about the axis of the drive member.

In the past problems have been encountered in providing efficient interconnecting means for mounting the inner cutter to the drive means to allow for efficient drive of the inner cutter. Further means must be provided to both mount the inner cutter for ready detachment when necessary and for securely mounting the same against accidental disconnection during operation. Various means, such as interlocking pins, lock washers and bifurcated detenting drive arms have been used in the past to interconnect the inner cutter to the drive means. Typical of these prior art devices are disclosed in U.S. Pat. Nos. 2,900,719; 2,908,970; 3,290,781; 3,783,508; and 3,838,314. Although these known devices have proven generally satisfactory they present relatively complex assembly procedures leading to increased manufacturing costs both in time and parts.

It is an object of the present invention to provide novel means for mounting an inner cutter assembly in an electric dry shaver.

Another object is to provide novel means for maintaining an inner cutter in driving relationship with the undersurface of a foil type outer cutter.

Another object is to provide novel inner cutter drive means which allows for universal swiveling movement of the inner cutter about the axis of the drive member upon downward or sideways flexing of the foil outer cutter during use of the shaver.

Another object is to provide novel drive means for an inner cutter assembly which may be utilized with drive means which is movable in either a linear or an arcuate path.

A still further object is to provide a novel mounting means for an inner cutter which includes means for securely attaching the inner cutter to the motor operated drive means and which means is when desired operable to readily release the inner cutter assembly from the drive means.

SUMMARY OF THE INVENTION

The present invention contemplates a novel cutter head assembly for an electric dry shaver wherein the outer cutter member comprises a foil member in engagement with a movable inner cutter which is mounted on a support member. Motor operated drive means are interconnected to the central portion of the support member whereby when the foil outer cutter is flexed downwardly or sideways during use of the shaver in the direction of the inner cutter during operation of the shaver the inner cutter will move in the same direction without losing contact with the foil. The motor operated drive means for the support member includes a drive arm disposed in driving relationship with the central portion of the support member and is maintained in contact with the support by an arcuate shaped drive head which provides a universal connection between the drive arm and the inner cutter support member to permit swiveling movement of the inner cutter.

The above and other objects and advantages of the present invention will appear more fully hereinafter from a consideration of the detailed description which follows taken together with the accompanying drawings where one embodiment of the invention is illustrated.

DESCRIPTION OF THE DRAWINGS

In the drawings:

FIG. 1 is a fragmentary perspective view of the upper portion of an electric dry shaver incorporating the present invention;

FIG. 2 is a fragmentary front elevational view of the electric dry shaver of FIG. 1 with parts of the casing broken away to show portions of the interior thereof;

FIG. 6 is a diagrammatic front view of the inner cutter showing the directions of movement of the cutter support member; and FIG. 7 is a diagrammatic plan view of FIG. 6.

DETAILED DESCRIPTION OF THE INVENTION

Figure 3:
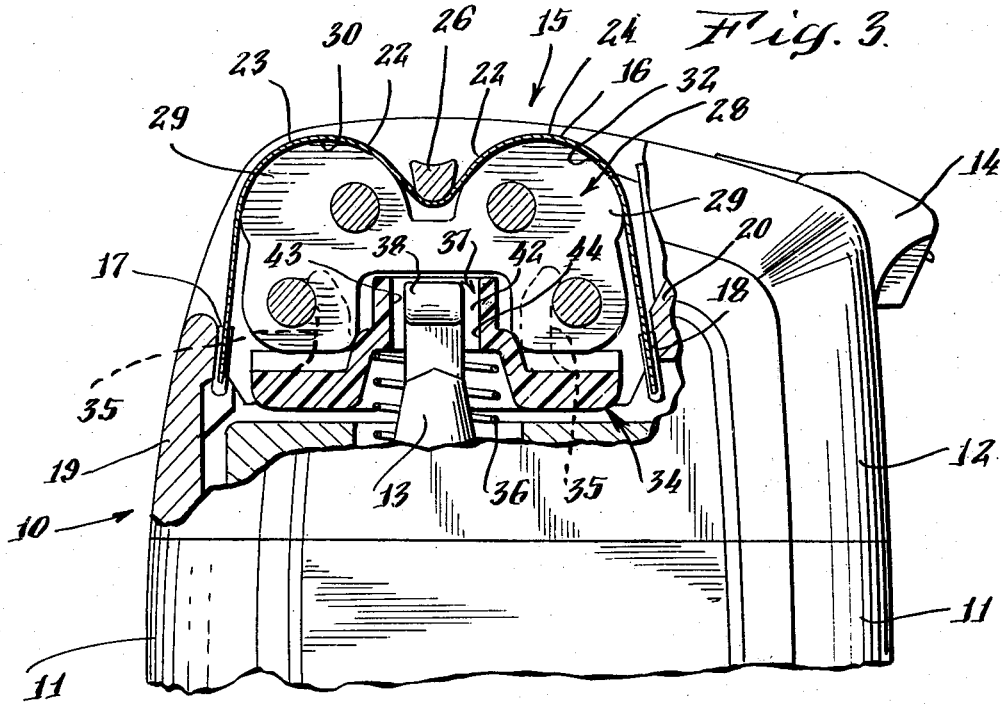
FIG. 3 is a fragmentary side elevational view of the shaver taken on the line 3—3 of FIG. 2.
Figure 4:
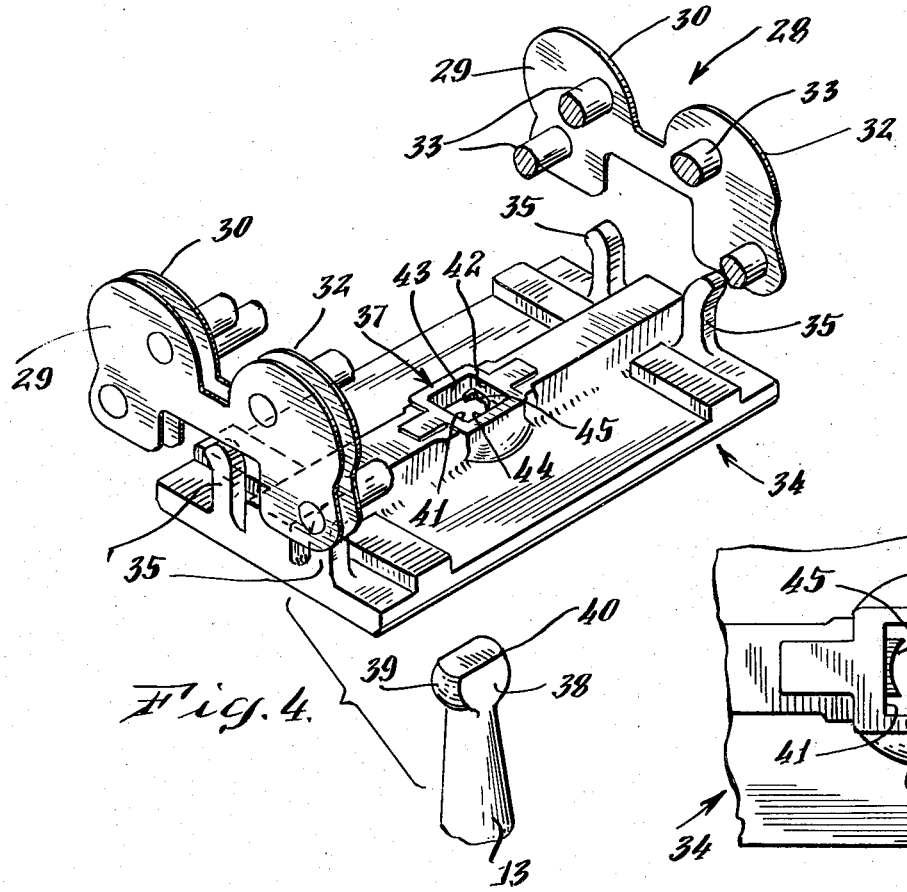
FIG. 4 is an exploded perspective view of the inner cutter assembly and drive means therefor.
Figure 5:
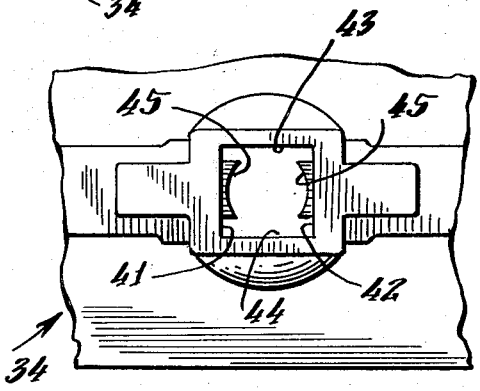
FIG. 5 is a fragmentary plan view of the drive connection in the inner cutter support member.

Referring now to the drawings for a more detailed description of the present invention, an electric dry shaver is generally indicated by the reference numeral 10 in FIGS. 1 to 3. Shaver 10 includes a casing made of a hard plastic material and comprises a main body section 11 and a hairpocket section 12. Hairpocket 12 is detachably mounted on main casing section in a well-known manner such as by spring biased releasable detent (not shown).

A motor (not shown) is provided within main body portion 11 for operating an auxiliary trimmer device 14 and a main cutter head assembly generally indicated by the reference numeral 15.

Cutter head assembly 15 includes an outer cutter comprising a generally rectangular flexible foil member 16 having spaced marginal portions 17 and 18 (FIG. 3) secured to spaced sidewall portions 19 and 20 of hairpocket 12 in any well-known manner (not shown). The foil 16 is made of nickel by an electroforming process and is provided with a plurality of apertures 22 for combing hair bristles into the cutter head 15. Foil 16 in mounted position on casing section 11 includes spaced arcuate shaped bowed cutting rows 23 and 24. Rows 23 and 24 are spaced one from the other by a bar member 26 which extends longitudinally accross hairpocket 12. Rows 23 and 24 are maintained in arcuate shape by the engagement of movable inner cutter assembly 28 with the undersurface of the foil 16. Inner cutter assembly 28 is operably by a motor drive arm 13 in a manner to be hereinafter explained in further detail.

Inner cutter assembly 28 comprises a plurality of spaced metal blades 29 each having a pair of arcuate shaped cutting edges 30 and 32. Rods 33 interconnect blades 29 in aligned relationship and which blades 29 are mounted on a support member 34. Support member 34 comprises a rectangular shaped frame having detent fingers 35 in locking engagement with lower rods 33 of inner cutter assembly 28 to maintain inner cutter blades 29 securely thereon. A spring 36 located around drive arm 13 engages the undersurface of support 34 and urges inner cutter assembly 28 and aligned arcuate cutting edges 30 and 32 into engagement with the undersurface of foil cutting rows 23 and 24 respectively.

As mentioned it is a feature of the present invention to provide novel means for mounting inner cutter assembly 28 on motor drive arm 13 (FIGS. 2 and 3). To this end support member 34 is provided with a rectangular shaped drive slot 37 at the central portion thereof. Drive arm 13 includes an arcuate shaped rounded drive head 38 mounted in drive slot 37 with the forward and rear surfaces 39 and 40 thereof (FIG. 2) in contact with endwalls 41 and 42 of slot 37. The side surfaces of drive head 38 are spaced from sidewalls 43-44 of slot 37 to allow for either sideways or rotative movement of support 34 about head 38 without the latter losing contact with the endwalls of 41 and 42 of slot 37. Spaced detent tabs 45 are provided on the lower portions of endwalls 41-42 to prevent upward release of support member 34 from drive arm 13 in the direction of arrow A in FIG. 2. In order to remove support 34 from drive head 38 hairpocket 12 must be removed from casing section 11. Support 34 is then rotated from the position shown in FIG. 7 to a position where at the tabs 45 are rotated free of the rounded ends of head 38 by support 34 may be lifted from drive arm 13.

In operation of shaver 10 as support member 34 is reciprocated by drive arm 13 in a linear direction as foil 16 is pressed against the user's skin support member 34 will bend to move downardly in the direction designed by the arrow B in FIG. 2. Inner cutter 28 will follow in the direction of the pressure exerted against the foil 16 and against the resilient restraining action of spring 36. Support 34 may also tend to rotate or move sideways about drive head 38 in the downward movement as lateral pressure is exerted against the foil 16. As diagrammatically illustrated in FIGS. 6 and 7 the novel interconnection of drive head 38 to drive slot 37 will allow for constant contact of drive head 38 with endwalls 41–42 of drive slot 37 in any direction of movement of inner cutter 28 as indicated by the arrows c, d, e, f, g, h, i and k as inner cutter 28 is reciprocated.

It will be apparent from the foregoing description that the novel inner cutter mounting means has many advantages in use. One advantage is that inner cutter assembly 28 is securely connected to the drive means 13 without the provision of additional parts or complicated forming of interconnection means. In addition the novel configuration of drive slot 37 and drive head 38 provides for universal movement of inner cutter 28 on drive arm 13 without the latter losing contact therewith or inner cutter 28 with the undersurface of the foil 16 thereby providing for a more efficient shaving action. Another advantage is that the disclosed novel drive connection may be used with a drive arm movable either in a linear or arcuate path in the same manner without loss of efficiency.

Although one embodiment of the present invention is illustrated and described in detail it is to be expressly understood that the invention is not limited thereto. Various changes can be made in the design and arrangement of parts without departing from the spirit and scope of the invention as the same will now be understood by those skilled in the art.

What is claimed is:

1. An electric shaver comprising, a. a flexible outer cutter and a movable inner cutter, b. a member for supporting said movable cutter, c. a drive slot having a pair of opposed endwalls and sidewalls formed in said support member, d. spring means contacting said support member for urging said movable cutter in hair shearing contact with said outer cutter, e. an elongated drive arm having a longitudinal axis and interconnected with said drive slot operable to dirve said support member and inner cutter in a reciprocatory path, f. a drive head formed on said drive arm along said longitudinal axis, said drive head having an axis parallel to said reciprocatory path and also a lateral axis extending perpendicular to said reciprocatory path, said drive head having opposed parallel surfaces terminating at opposed rounded surfaces arranged along said parallel axis and engaging each of said endwalls in driving relationship, said parallel surfaces being arranged in spaced relationship to said sidewalls for allowing linear movements of said support member relative thereto along the longitudinal and lateral axes and rotational movements relative to the drive head along the longitudinal, parallel and lateral axes without loss of contact of said rounded surfaces with the engaged portions of the drive slot walls, and g. detent tabs formed on lower wall portions of the drive slot spaced from said engaged portions of the walls along said longitudinal axis and adapted for engagement with said rounded surfaces for limiting axial movement of the support member along said longitudinal axis and for release of the support member from the drive arm upon rotation with respect to said longitudinal axis whereby said detent tabs are rotated free of said rounded surfaces.

2. An electric shaver comprising, a. a flexilbe bow-shaped foil outer cutter, b. an inner cutter having arcuate-shaped cutter blades, c. a frame for supporting said cutter blades, d. spring means engaging said support frame for urging said inner cutter into shearing engagement with said outer cutter, e. a motor operated drive arm having a longitudinal axis and a rounded drive head disposed within a rectangular-shaped drive slot formed in said support frame, f. said rounded drivehead permitting swiveling movement of said support frame about said axis of the drive arm, and g. detent means formed on spaced lower wall portions of said drive slot for preventing release of said support frame from said drive head upon a swiveling movement of less than 45° of said support frame with respect to said drive arm axis.

3. The shaver of claim 2 wherein said detent means are adapted for engagement with said rounded drive head for limiting axial movement of said support frame with respect to said drive arm.

4. An electric shaver comprising, a. a flexible outer cutter and a movable inner cutter;

b. a support member mounting said inner cutter in shearing engagement with said outer cutter;

c. spring means maintaining said inner cutter in said shearing engagement;

d. a motor operated drive arm in driving engagement with said support member, said drive arm operable for driving said inner cutter relative to said outer cutter;

e. means provided on said drive arm and said support member for universal swiveling and lateral movements of said support member relative to said drive arm upon flexing movement of said outer cutter;

f. said means for universal swiveling and lateral movements of the support member relative to the drive arm include an arcuate shaped drive head at a terminal end of said drive arm and a rectangular shaped drive slot formed in said support member; and g. detent tabs provided on spaced lower wall portions of said drive slot prevent upward release of the support member from the drive head and whereby the support member is released from the drive arm upon rotation of the support member to a position whereat said detent tabs are rotated free of said drive head.

5. The shaver of claim 4 wherein arcuate shaped portions of said drive head are in continuous contact with first wall portions of said drive slot during movement of said inner cutter relative to said outer cutter and during flexing movement of said outer cutter, and said first wall portions of the drive slot pivot in a universal swiveling movement about said arcuate shaped portions of the drive head.

6. The shaver of claim 5 wherein other portions of said drive head are spaced from other wall portions of drive slot and during flexing movement of the outer cutter said support member moves laterally in the direction of said spacing.

7. An electric shaver comprising, a. a flexible bow-shaped foil outer cutter, b. an inner cutter having arcuate-shaped cutter blades, c. a frame for supporting said cutter blades and having a rectangular-shaped drive slot formed therein, said drive slot being formed with spaced endwalls and spaced sidewalls, d. spring means engaging said support frame to both urge said inner cutter into shearing engagement with said foil outer cutter and to permit downward or lateral flexing movement of said foil outer cutter upon external pressure being applied thereto, e. an elongated motor operated drive arm extending from said motor having a longitudinal axis and terminating in a drive head disposed within said drive slot, said drive head having rounded opposite end surfaces and spaced side surfaces, said end surfaces being in driving contact with opposed portions of said endwalls, f. said side surfaces of the drive head being spaced from the sidewalls of said drive slot allowing lateral and universal swiveling movements of said inner cutter about the longitudinal axis of said drive arm upon said downward or lateral flexing movement of the foil outer cutter, and g. detent means formed on spaced lower wall portions of said drive slot included a portion of each of said endwalls projecting into the drive slot in the direction of the drive arm, said projecting portions are adapted for engagement with said rounded end portions of the drive head for limiting axial movement of said support frame with respect to said drive arm, and said support frame is adapted for release from said drive arm upon rotation with respect to the drive head whereby said projecting portions are rotated of said rounded end surfaces.

* * * * *